United States Patent [19]

Hamm

[11] Patent Number: 4,485,798

[45] Date of Patent: Dec. 4, 1984

[54] BOW STRING RELEASE

[75] Inventor: Harold M. Hamm, Wisconsin Rapids, Wis.

[73] Assignee: H. H. & A. Sports, Inc., Wisconsin Rapids, Wis.

[21] Appl. No.: 496,392

[22] Filed: May 20, 1983

Related U.S. Application Data

[63] Continuation of Ser. No. 137,288, Apr. 4, 1980, abandoned.

[51] Int. Cl.[3] ..... F41B 5/00

[52] U.S. Cl. ..... 124/35 A

[58] Field of Search ..... 124/35 A, 41 A, 24 R, 124/23 R

[56] References Cited

U.S. PATENT DOCUMENTS 2,417,791 3/1947 Tysziewicz ..... 124/35 A 2,488,597 11/1949 Konold ..... 124/35 A 3,954,095 5/1976 Lewis ..... 124/35 A

*Primary Examiner*—Richard J. Apley

*Assistant Examiner*—William R. Browne

*Attorney, Agent, or Firm*—Bayard H. Michael

[57] ABSTRACT

A bow string is retained between the rubber block in the notch and the retaining pin projecting laterally from the sear which is engaged by the retractable plunger. When the trigger is mounted on the plunger pull pin is either pushed or pulled, the pin is pulled back to retract the plunger and release the sear which then releases the bow string. The sleeve on the end of the pull pin can be adjusted to adjust the trigger travel necessary to release the sear. The handle is captured between the body and the head of the connector threaded into the body so the handle can be rotated relative to the body and secured in a desired position.

5 Claims, 4 Drawing Figures

BOW STRING RELEASE

This application is a continuation of application Ser. No. 137,288, filed Apr. 4, 1980 which is expressly abandoned in favor of this application.

FIELD OF THE INVENTION

The invention relates to a bow string release having a handle provided with a bow string receiving notch in which the string is held by a retainer pin until a trigger is actuated.

BACKGROUND PRIOR ART

The nature of the string release obtained with a bow string release increases the uniformity of release as compared with holding and releasing the string with fingers. This results in more accuracy since the flight of the arrow is more uniform. Releases are used in target shooting and hunting. To date releases are subject to some or all of the following problems.

The retainer holding the string in the notch is moved across the string during release and results in a slight side force on the string tending to "fishtail" the arrow as well as causing wear on the string. The relationship of the handle relative to the notch is generally fixed by the designer's conception of the most comfortable hand position at full draw of the bow. This does not accommodate the individual's ideas. The trigger action is limited to either pull or push action by either thumb or finger actuation rather than permitting user selection. The prior releases must be retained in the string by locating mocks or buttons fixed on the string . . . otherwise they will slide along the string. Finally, the art does not permit user adjustment of the trigger action.

SUMMARY OF THE INVENTION

Figure 1:
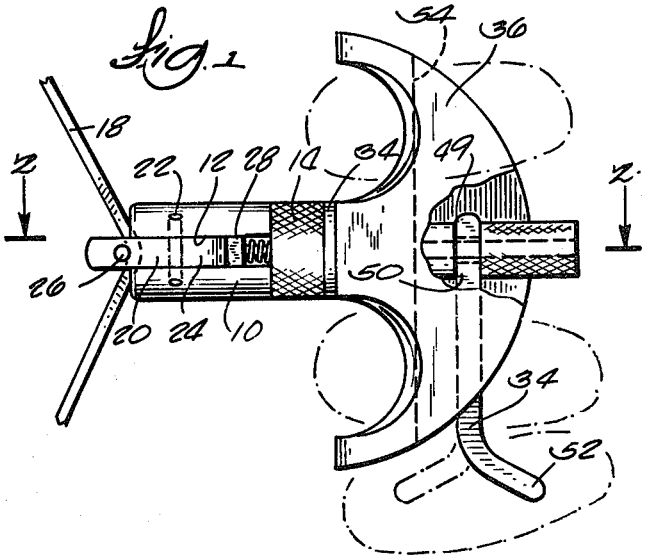
FIG. 1 is an elevation showing the bow string release with the string in the drawn position.
Figure 3:
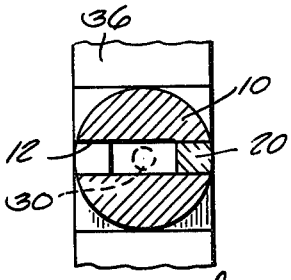
FIG. 3 is a fragmentary vertical section taken on line 3—3 of FIG. 2.

The present invention overcomes the limitations of the prior art by providing a barrel-shaped body having a string receiving notch at its outer end with a sear pivoted in the barrel adjacent the notch with a string retaining pin projecting across the notch when the sear is retained in its operative position by a releasing plunger. The plunger shaft or pull pin projects from the outer end of the barrel on the axis of the body. This permits the handle to be connected to the body on the axis thus making it possible to rotate the handle relative to the notch (string). The trigger is mounted in the handle for connection to and actuation of the pull pin by either a push or pull action to withdraw the releasing plunger from obstructing the sear. The string retainer pin falls away from the string when the sear is released. This minimizes string wear and imposition of lateral forces to the string during release. A rather firm rubber (elastomer) block is force fit into the notch and has such thickness that the space between the retainer pin and the elastomer is less than the diameter of a bow string. This serves to fix the release on the string so it will not slide along the string.

DESCRIPTION OF THE PREFERRED EMBODIMENT

The body 10 of the release has a deep notch 12 extending back to the knurled portion 14 of the body and is provided with a shallow notch 16 at 90° to the deep notch to receive a bow string 18. Sear 20 is mounted on pivot pin 22 at one side of the shallow notch. The right end 24 of the sear is curved to clear plunger 28 during release and the other end of the sear is provided with a retainer pin 26 which will hold the bow string when the sear is captured under the square releasing plunger 28 slidably mounted in the deep notch 12 and . constrained by the notch against rotation.

Shaft or pull pin 30 extends rearwardly from plunger 28 through the center of connector 32 and through a hole in trigger 34. Body 10 is threaded onto the forward end of the tubular connector 32 with a Nylon washer 33 sandwiched between the body and handle 36. Coiled spring 44 is compressed between plunger 28 and the forward end of connector 32 to bias the plunger to the left in FIGS. 1 and 2. An adjusting sleeve 46 is threaded on the end of pull pin 30. If adjusting sleeve 46 is turned down on the threads of shaft 30, it will result in shaft 30 and plunger 28 moving to the right. This will vary the position of the releasing plunger relative to the corner 48 of the sear. The amount by which the plunger overlaps the sear when the release is cocked (string retained) determines the amount of trigger travel necessary to release the sear so the string will be released.

The trigger, as can be seen in FIG. 1, can be moved rearwardly to pivot about its forward corner 49 and pull back against sleeve 46 to retract the releasing plunger or it can be moved forwardly to rock about the portion 50 of the trigger confronting the adjacent corner of the connector head 38 to react against sleeve 46 and pull the pull pin and plunger back. Thus the trigger can be pushed or pulled to cause the plunger to retract and release the sear. The outer end 52 of the trigger 34 is curved so it can be mounted either in the position shown in solid lines in FIG. 1 or in the position shown in dotted lines in FIG. 1, depepding on which is more comfortable for the user. It will be appreciated the major portion of the trigger lies within groove 54 in the handle and can be positioned to extend downwardly as shown in FIG. 1 or can be positioned to extend upwardly, but this latter feature is not of great importance because the handle can be rotated relative to the body and indeed can be made to occupy any position relative to the body. If it is desired to fix the body relative to the handle so that it will always be given position relative to the body, the body is turned down on the threaded end of connector 32 to clamp the handle between Nylon washers 34 and 40. If, on the other hand, it is desired to have the handle freely rotatable relative to the body, the body is not tightened enough to clamp the handle but is tightened just enough to let the handle rotate relative to the barrel with as much or as little drag as desired. When the desired adjustment has been made set screw 55 can be turned down to fix the body relative to the connector and hold the adjusted position. It may be noted that if the body is to be fixed relative to the handle as mentioned above the body is, as stated, turned down to clamp the handle and the set screw 55 can be turned down but this is not necessary due to the clamping action already obtained.

After the handle has been adjusted to the desired rotary position or has been adjusted for free rotation the next step for the user is to adjust the trigger stroke. To this end, the adjusting sleeve 46 is turned in or out to increase or decrease the trigger stroke necessary to release the sear. When the desired trigger action is obtained, the set screw 56 inside the adjusting sleeve 46 is turned down against the outer end of pull pin 30 to lock the adjusting sleeve 46 relative to the pin and maintain the desired setting.

Figure 2:
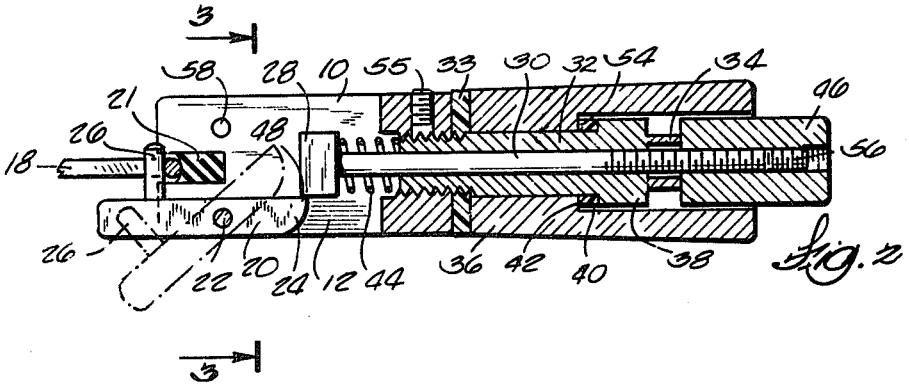
FIG. 2 is a horizontal section taken on line 2—2 of FIG. 1.
Figure 4:
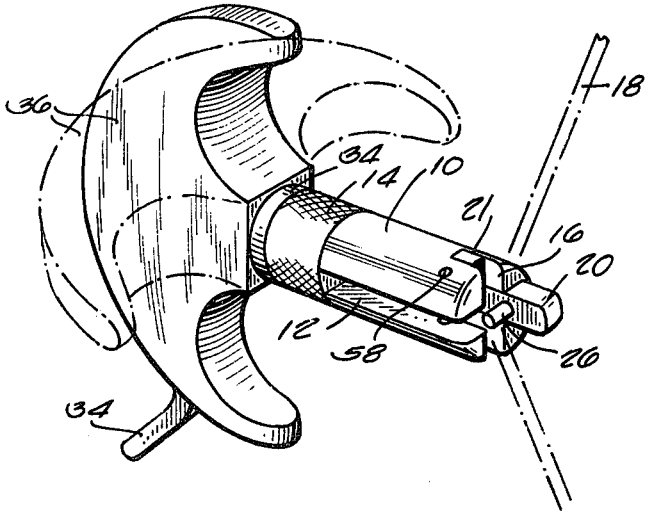
FIG. 4 is a perspective view of the release in the drawn position and illustrating the manner in which the handle can be rotated relative to the body of the release.

The sear and the plunger should be case hardened so the interacting corners will not wear down. When the sear is released and moves to the dotted line position shown in FIG. 2, it will be noted the string retainer 26 more or less falls away from the string 18 to obtain a smooth release. When the release is cocked as shown in FIG. 2, the retainer squeezes the string 18 between the retainer and the rubber block 21 forced into the shallow notch 16 and dimensioned so that it leaves less space between the rubber block and the retainer than the diameter of the string. With this arrangement the cocked release can be carried on the string and will not slide along the string. When the sear is released, it rotates counterclockwise (FIG. 2) at high velocity and rather than allowing it to rotate too far (or spin), the stop in 58 is positioned to limit rotation of the sear.

With this construction it is possible to secure the handle in any desired relationship to the body or to permit the handle to rotate freely with respect to the body. This gives the user complete freedom of choice. The trigger can be mounted for push or pull action and is formed so that it lies close against the handle or projects clear of the handle trigger for greater access. Generally, it is more convenient to have the trigger close to the handle when it is desired to release by pressing (pushing) the thumb on the trigger, for example. But if it is desired to release by pulling the trigger, then it is generally more convenient to have the trigger stand clear of the handle for better access by the finger as illustrated in dotted lines in FIG. 1. The trigger travel can be adjusted down to a "hair trigger" action if desired.

I claim:

1. A bow string release comprising, a body having a string receiving notch therein, a sear pivoted in the body adjacent the notch and having string retaining means operative to retain a bow string in the notch when the sear is in its operative position, a release plunger slidably mounted in said body for movement between a first position and a retracted position, said plunger engaging said sear in said first position to retain the sear in its operative position and releasing said sear upon movement to said retracted position, a connector threaded into said body and having an enlarged head remote from the body, a handle having a portion captured between said head and the body and being freely rotatable on the connector when the connector is in one position relative to the body and being clamped between said head and the body when the connector has been threaded further into the body, said release plunger extending through the connector and permitting rotation of the connector relative to the plunger, and a trigger rotatable with the handle relative to the connector and plunger and operative to retract the plunger.

2. A bow string release according to claim 1 including an adjusting nut threaded onto the end of the plunger and operative to adjust the position of the plunger relative to the sear, and a lock nut threaded into said adjusting nut and jamming against the end of the plunger to lock the adjusting nut in an adjusted position.

3. A bow string release according to claim 2 in which said trigger has a hole therethrough and said plunger passes through the hole in the trigger, said adjusting nut bearing against said trigger.

4. A bow string release according to claim 3 in which said trigger can be pulled or pushed to retract the plunger and release said sear.

5. A bow string release including, a body having a string receiving notch therein, a sear pivotally mounted in the body and having an operative position in which it projects across the notch to retain a string in the notch, means for retaining said sear in said operative position and for releasing the sear, a resilient elastomeric member fixed in the base of the notch and having a thickness which when added to the thickness of the bow string is greater than the space between the sear and the base of the notch when the sear is in said operative position so the elastomeric member is engaged and compressed by the string when the string is captured between the sear and said elastomeric member by the sear projecting across the notch.

* * * * *